United States Patent [19]

Essers et al.

[11] Patent Number: 5,039,905

[45] Date of Patent: Aug. 13, 1991

[54] WELDING CONNECTION FOR AN ELECTRIC LAMP

[75] Inventors: Wilhelmus G. Essers, Bladel; Gerardus A. M. Willems, Hoogeloon; Jozef J. C. Buelens, Eindhoven, all of Netherlands

[73] Assignee: U.S. Philips Corporation, New York, N.Y.

[21] Appl. No.: 475,626

[22] Filed: Feb. 6, 1990

[30] Foreign Application Priority Data

Jul. 4, 1989 [NL] Netherlands ..... 8901697

[51] Int. Cl.[5] ..... H01J 5/48

[52] U.S. Cl. ..... 313/318; 420/584.1; 445/27

[58] Field of Search ..... 313/318; 420/580, 584, 420/587; 219/56.1, 85.14, 85.21, 146.23; 445/27

[56] References Cited

U.S. PATENT DOCUMENTS

| | | | |
|---|---|---|---|
| 1,650,289 | 11/1927 | McGinley | 313/318 |
| 2,708,702 | 5/1955 | Albrecht | 219/137 R |
| 2,809,279 | 10/1957 | Albrecht | 219/56.1 |
| 2,892,923 | 6/1959 | Kuebler | 219/58 |
| 3,778,663 | 12/1973 | Beeson et al. | 313/318 |
| 3,885,186 | 5/1975 | Vause | 313/318 |
| 3,897,124 | 7/1975 | Pagnotta | 439/734 |
| 4,449,072 | 5/1984 | Osada | 313/318 |
| 4,458,136 | 7/1984 | Wagatsuma | 445/27 |
| 4,914,345 | 4/1990 | Suster et al. | 420/485 |

FOREIGN PATENT DOCUMENTS

| | | |
|---|---|---|
| 0057006 | 8/1982 | European Pat. Off. . |
| 0444958 | 3/1936 | United Kingdom . |

*Primary Examiner*—Donald J. Yusko
*Assistant Examiner*—Diab Hamadi
*Attorney, Agent, or Firm*—Robert J. Kraus

[57] ABSTRACT

The electric lamp has a lamp cap (6) with a contact member (9) at the base portion (8), a current supply conductor (4, 5) being passed to the exterior through said contact member. The current supply conductor (4, 5) is welded to said contact member (9) by a separately supplied solidified drop of essentially copper, nickel, copper/nickel, chromium/nickel/iron or aluminium containing 1–10% by weight of a metal addition.

2 Claims, 1 Drawing Sheet

WELDING CONNECTION FOR AN ELECTRIC LAMP

BACKGROUND OF THE INVENTION

The invention relates to an electric lamp comprising a translucent lamp vessel, an electric element in the lamp vessel, current supply conductors extending to the electric element, a lamp cap connected to the lamp vessel and having a sheath portion and a base portion carrying an electric contact member, the electric contact member having a surface through which a current supply conductor is passed to the exterior, which current supply conductor is welded to said surface.

Such an electric lamp is known, for example, from GB 444 958 (1936-3-23).

The lamp according to GB 444 958 has a lamp cap with a contact member at its base portion, which has a sunken portion, through which a current supply conductor is passed to the exterior. The current supply conductor is fixed in the sunken portion with an electric resistance weld. With this lamp, a contact element of a lamp holder, in which the lamp is arranged, touches the contact member of the lamp cap around the sunken portion thereof. This results in that the vulnerable welding connection is not subjected to mechanical load when the lamp is arranged in the lamp holder.

The known lamp has a number of great disadvantages. The lamp must necessarily be provided with an unconventional lamp cap because of the unconventional contact member at the base portion thereof. The contact member at the base portion is very large. In fact, it must be possible for the member to make contact with a mass electrode and with a welding electrode. Moreover, it must comprise a sunken portion. However, conventional lamp caps are in use, in which the contact member has a diameter of only 2.5 mm, for example the E5 lamp cap. Moreover, conventional lamp caps are in use, in which the base portion has two contact members, for example the B22d lamp cap. In this case, there is no room for two contact members of large dimensions. It is further difficult to make a good resistance weld between the current supply conductor and the contact member because these elements are in linear contact with each other during welding. The welding current is consequently distributed over a line, as a result of which it is possible that nowhere along the wire such a high current density occurs that a good weld is obtained.

U.S. Pat. No. 2,892,923 (1959-6-30) discloses a lamp in which a current supply conductor is welded to a contact pin at the base portion, through which said current supply conductor is passed. When establishing the weld connection, a first electrode is in electrical contact with the shaft of the contact pin and a second electrode at a certain distance from said pin is in contact with the free end of the current supply conductor. Between the area at which the current supply conductor is passed out of the pin and a third electrode, a discharge arc is drawn, which welds the current supply conductor to the pin. The welding connection is established by means of the locally molten material proper of the wire and the pin. Because of the contactings with electrodes which have to take place at a certain distance from the welding point, this manner of securing is not suitable for the contact member at the base portion of, for example, conventional Edison and Swan lamp caps.

U.S. Pat. No. 3,897,124 (1975-7-29) also discloses a lamp having a current supply conductor welded to a contact member at the base portion. However, the lamp cap is of an unconventional type. Its contact member at the base portion has a continuous elevated edge at its periphery. The contact member has centrally around an opening an outwardly protuberant edge. When establishing the weld connection between the contact member and the current supply conductor passed through this opening in this member to the exterior, a hollow first electrode is arranged over the contact member so as to be in contact with the elevated edge. Between a second electrode inside the first electrode and the contact member, a discharge arc is drawn. The latter causes the outwardly protuberant edge to melt and to contact with the current supply conductor, which also melts. Due to the flow of the melts, a welding connection is formed, which consists of the material proper of the contact member and the current supply conductor.

The welding connection is sunken with respect to the elevated edge, which must make contact with a contact element of a lamp fitting. The elevated edge thus protects the welding connection from contact with a contact member of a lamp holder. The welding connection has a rough surface and, if in the absence of the elevated edge it should contact a contact element in a lamp holder, it would consequently have an undefined small contact surface with said element. As a variation of this manner of connecting, the said patent specification mentions the same configuration of contact member and welding electrodes, in which the second electrode is a consumable electrode. A welding connection is then established by mixing the material proper of the contact member, the material proper of the current supply conductor and the material of the consumable electrode. This variation with a consumable electrode is not recommended by the patent specification.

This known lamp has the disadvantage that its lamp cap has an unconventional shape, is intended to make contact only at the edge of the contact member with a lamp holder, requires a comparatively large contact member and especially must be touched when establishing the welding connection in order to make a good electrical contact with the first electrode. Another disadvantage is that the energy of the discharge arc can damage the base portion of the lamp cap. For example, the base portion may crack or the material thereof may be decomposed. A risk is that the current supply conductor melts through within the lamp cap under the action of the heat of the discharge arc and loses its contact with the welding connection. This risk is great if the current supply conductor takes the form of a fuse wire, which in the finished lamp must melt upon heat development due to an excessively high current through the lamp.

EP 0 057 006 $A_2$ (1982-8-4) discloses an H4 car lamp, in which current supply conductors are secured in the same manner to contact members at the base portion of the lamp cap by drawing a discharge arc between an electrode and an outwardly protuberant edge of an opening in a contact member, through which a current supply conductor is passed to the exterior. In the lamp cap of an H4 lamp, the contact members consist of rectangularly bent strips, which extend to a certain distance from the base portion of the lamp cap. In these contact members, there is plenty of room to make contact with a mass electrode in order to draw with a second electrode an arc to establish a welding connection with a melt of the material proper of the contact member and a melt of the material proper of the current supply conductor. When establishing this connection, however, a comparatively high thermal load of the material of the base portion of the lamp cap occurs.

Several Patent Specifications, inter alia U.S. Pat. No. 2,708,702 (1955-5-17), U.S. Pat. No. 2,809,279 (1957-10-8) and U.S. Pat. No. 4,458,136 (1984-7-3), describe the step of connecting a current supply conductor to the sheath portion of a lamp cap by drawing a discharge arc between the free end of the current supply conductor and an electrode, this end of the current supply conductor then melting and the melt of said conductor itself forming a connection between the conductor and the lamp cap. The sheath of the lamp cap offers plenty of room for a mass electrode. When pressing the lamp cap against the lamp vessel, the sheath portion of the lamp cap contacts the current supply conductor, which is passed to the exterior between the lamp cap and the lamp vessel. The cold lamp cap causes the melt to solidify as soon as it touches the lamp cap.

As appears from the citations, attempts have been made already for many decennia to avoid securing current supply conductors to contact members at the base portion of a lamp cap by soldering. A disadvantage of securing to a contact member at the base portion by soldering is the risk of cold flow of the solder in a lamp fitting. As a result, high contact resistances and excessive heat development may occur in the lamp fitting. Very great disadvantages are further the long process duration of establishing a soldering connection. Not only the time required for heating, but also the time required for cooling the solder to solidification is long. In this cooling period, the lamp must be kept stationary in order to avoid that the solder is thrown away. Another very great disadvantage is the necessity of using a flux to cause the solder to flow and thus to adhere. The residues of the flux may give rise to the formation of a leakage path for electric current between contact members or between a contact member and the sheath portion of a lamp cap. As a result, shortcircuit may occur.

SUMMARY OF THE INVENTION

It is an object of the invention to provide a lamp of the kind described in the opening paragraph, which is provided with a lamp cap, which may be of a simple, for example a conventional, construction and has a simple welding connection of a current supply conductor with a contact member of said lamp cap.

According to the invention, this object is achieved in that the current supply conductor is held at the surface by a separately supplied solidified welding drop of essentially copper, nickel, copper/nickel, chromium/-nickel/iron or aluminium containing 0 to 10% by weight of a metal addition.

The lamp cap of the lamp according to the invention may be a conventional Edison or a conventional Swan lamp cap having a conventional flat plate, which is anchored as a contact member in the base portion of the lamp cap. The plate may consist of the conventional material, such as brass or nickel-plated brass.

The welding connection is formed by separately supplying and depositing a molten metal drop. Neither the contact member nor another portion of the lamp cap need then be touched by a tool.

The welding drop, for example of Al, Cu, Ni, Cu/Ni 70/30, Cr/Ni/Fe 20/10/70, can be obtained from a wire known as welding wire. Such wires mostly contain contaminations and further additions to influence, for example, the crystallization of the material. The welding drop may have, for example, a content of metal addition, such as, for example, silver, tin, aluminium, iron, niobium or manganese. In case it is desirable to increase the wetting capacity of a drop of copper, excellent results are attained with a small quantity of silver, for example about 0.8 to 1.2% by weight, and/or a few % by weight of tin, for example 5 to 8% by weight. Other metal additions are, for example, 7.5-9.5% by weight of Al, 0.1-0.6% by weight of Nb, 0.5-1.5% by weight of Mn.

The deposition of the welding drop can take place when the lamp cap with the contact member and the current supply conductor is cold, for example at room temperature, or when the lamp cap is hot, for example at a temperature of about 160° C. If the lamp cap is connected by means of a thermally curing cement to the lamp vessel, the lamp cap has such a temperature during or immediately after curing of this cement.

In general, the welding drop has a substantially circular boundary on the contact member.

If the welding connection has been established under comparatively hot conditions with a comparatively hot lamp cap and a drop having a comparatively high heat content, upon deposition a drop flows further out and becomes flatter than if the deposition takes place under comparatively cold conditions. In this case, the drop flows out to a smaller extend and has a free surface closer to a hemispherical shape. With regard to shape and size, the welding connection is very reproducible.

The welding connection substantially entirely consists of the material deposited as a drop. The contact member and the current supply conductor have been molten only superficially in a thin film at the area at which they are touched by the welding drop during the deposition. The welding drop solidifies in a few msec so that besides at the area at which the welding drop and a molten film either of the current supply conductor or of the contact member touch each other, a mixing up of the metals does substantially not take place. Also if, for example, a current supply conductor and a welding drop essentially consist of the same material, small differences in the nature of contaminations or additions can render it possible to distinguish the materials from each other. Since further the current supply conductor and the contact member have been molten only very superficially in a thin film, they have under this film their own crystal structure and the solidified welding drop has its own crystal structure. These structures can be clearly distinguished in sections of the welding drop, the contact member and the solidified welding drop. The fibrous crystal structure the current supply conductor has due to the process in which the wire is drawn has changed within the welding drop due to the transient heating, while also in a zone of comparable size just located outside the welding drop recrystallization has occurred. In a known welding connection obtained by drawing an electric arc to the current supply conductor and causing said conductor to melt, the thermal load of said conductor has been considerably higher and said conductor has recrystallized over a great length.

The solidified welding drop has a smooth surface and is very suitable to make contact at its free surface with a contact member of a lamp holder, inter alia because the drop does not exhibit a cold flow under conditions usual for lamps, but also because the drop is very reproducible with regard to shape and size, as a result of which the overall length of a lamp lies within very narrow limits also if the welding connection projects above the surface of the contact member. As a result, it is not necessary at all to apply the welding drop to a sunken part of the contact member. On the contrary, the welding drop may project above the whole surface of the contact member. This renders is possible for the lamp according to the invention to have a conventional lamp cap with a conventional flat contact member.

A possibility to make a weld by causing a molten metal drop to fall onto the articles to be interconnected is known as Electric Arc Spraying and has been described in general sense already in U.S. Pat. No. 2,982,845 (1961-5-2). In this case, an electrode is present in a chamber which is open on the lower side and is traversed, for example, by argon or argon/hydrogen. A discharge arc is produced between said electrode and a narrowed part in said chamber. A welding wire is passed into the discharge arc, after which the wire melts and forms a drop, which is taken along by the gas flow and falls onto the articles to be welded. The wire can be heated not only by the discharge arc, but also by causing a part of the arc current to flow through it.

In an analogous manner, welding material can be deposited on the contact member and on the current supply conductor without the lamp cap being touched by a tool and without subjecting the lamp cap or portions thereof to high temperatures, which could damage the base portion of the lamp cap or which could cause a fuse wire as current supply conductor to melt. Although the welding drop is at least at the melting temperature of the welding material, the welding drop has a limited volume and so a limited heat content.

It is also important that upon deposition of the welding drop no arc is drawn to the current supply conductor or the contact member because, when such an arc would be drawn, the arc current could flow through an electric element (a filament) of the lamp and could destroy it.

It is a matter of course that it is not essential to the invention which type of electric lamp is employed. The lamp may be an electric discharge lamp or an incandescent lamp. The element (a filament in the case of an incandescent lamp) may be accommodated in the lamp vessel in an inner envelope. In a halogen incandescent lamp, the lamp vessel, if present the inner envelope, comprises a halogen-containing filling. An inner envelope is generally present if the electric element is a pair of electrodes in an ionizable gas. The lamp vessel may be partly mirror-coated. Alternatively, the lamp vessel may be connected to a reflector body, which partly surrounds the lamp vessel.

BRIEF DESCRIPTION OF THE DRAWING

Embodiments of the lamp according to the invention are shown in the drawing. In the drawing.

DESCRIPTION OF THE PREFERRED EMBODIMENTS

Figure 1:
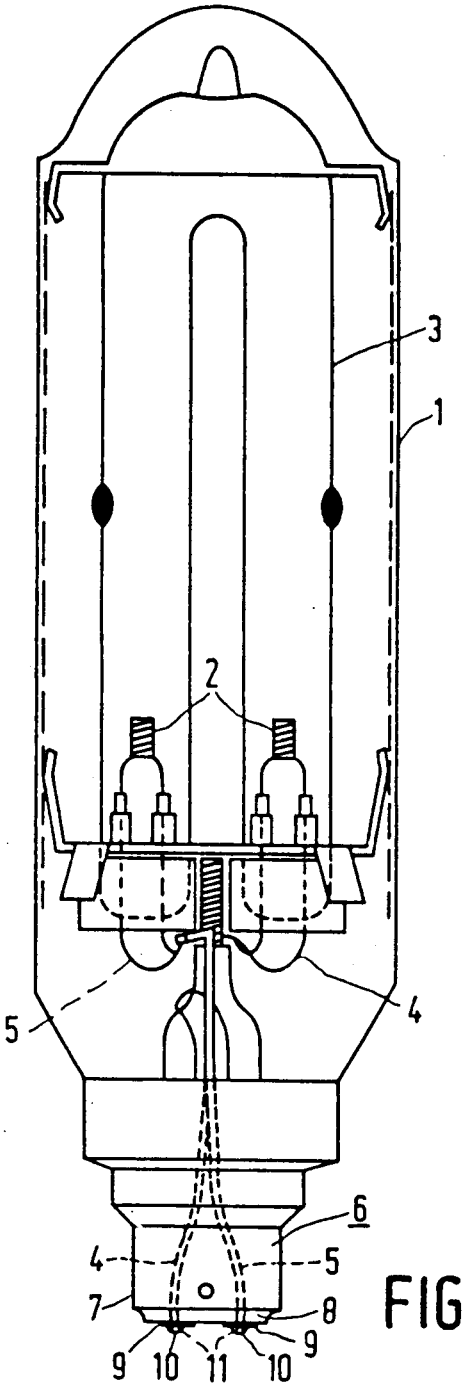
FIG. 1 is a side elevation of a discharge lamp.

The lamp shown in FIG. 1 has a translucent lamp vessel 1, in which an electric element 2, i.e. a pair of electrodes, is arranged. In the Figure, the pair of electrodes is surrounded by an inner envelope 3, which is filled with an ionizable gas, such as neon/argon and sodium vapour. Current supply conductors 4, 5 extend to the electric element 2. A lamp cap 6 having a sheath portion 7 and a base portion 8 carrying an electric contact member 9 is connected to the lamp vessel 1. The electric contact member 9 has a surface through which a current supply conductor 4 and 5, respectively, is passed to the exterior and on which said current supply conductor is welded.

In the Figure, the base portion 8 of the lamp cap 6 has two contact members 9 (see also FIG. 2), which each consist of a flat oval brass plate. The lamp cap 6 shown is a conventional lamp cap having a B-22 fitting and conventional contact members 9. The current supply conductors 4, 5 shown consist at the area of the contact members 9 of copper.

Figure 2:
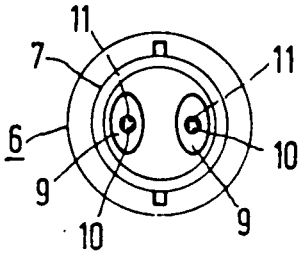
FIG. 2 is the elevation of the base portion of the lamp cap of FIG. 1.

In FIGS. 1 and 2, the current supply conductor 4 and 5, respectively, is held at the surface of the respective contact member 9 by a separately supplied solidified welding drop 10 of essentially copper, nickel, copper/-nickel, chromium/nickel/iron or aluminium containing 0 to 10% by weight of a metal addition.

In the lamp shown, the solidified welding drop 10 consists of nickel. The welding drop 10 touches the respective contact member 9 substantially with a circular boundary. The drop has a hemispherically curved free surface.

Figure 3:
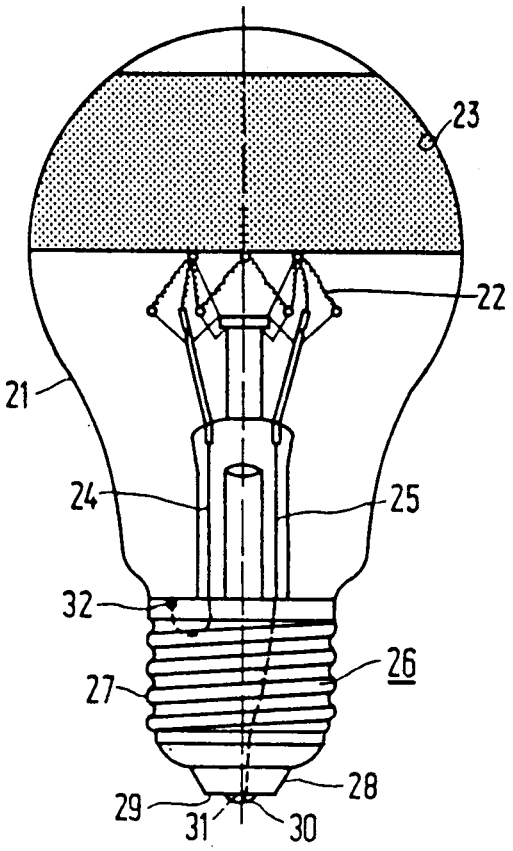
FIG. 3 is a side elevation of an incandescent lamp.
Figure 4:
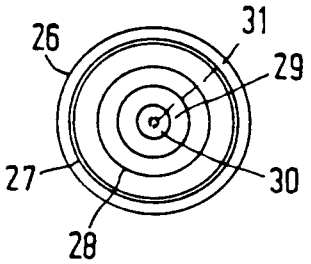
FIG. 4 is the elevation of the base portion of the lamp cap of FIG. 3.
Figure 5:
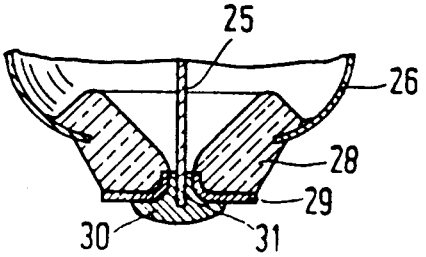
FIG. 5 shows on an enlarged scale a sectional view of the lamp cap of FIGS. 3 and 4.

In FIGS. 3 and 4, reference numerals designating parts corresponding to parts in FIGS. 1 and 2 are 20 higher than in FIGS. 1 and 2.

The electric element 22 of the lamp shown is a filament, while the lamp cap 26 is a conventional E27 lamp cap having a flat brass plate 29 as contact member at the base portion 28. The welding drop 30 consists of copper, nickel, copper/nickel, chromium/nickel/iron or aluminium containing 0 to 10% by weight of a metal addition, for example of copper containing 0.8% by weight of silver, and has a flattened shape with a substantially circular contact surface with the contact member 29. At said contact surface, a film of the contact member has been molten and is fused with the welding drop 30. Also a film of the current supply conductor 25, which consists in situ of 53.5% by weight of Cu, 45% by weight of Ni, 0.5% by weight of Fe and 1% by weight of Mn, used as a fuse has been molten and is fused with the welding drop. The current supply conductor 24 is secured at 31 to the sheath 27 of the lamp cap 26 by an arc weld. This connector too is a fuse wire, for example of the same composition as the current supply conductor 25, at the area where the weld is made. A current supply conductor 24 passed to the exterior over the edge of the lamp cap 26 is molten away until the melt touches the lamp cap 26 and fuses with it. The solidified drop 31 therefore essentially consists of the material of the current supply conductor 24 at its fusing area. The sheath 27 of the lamp cap 26 consists, for example, of aluminium, brass, nickel-plated brass and the like. The lamp vessel 21 has a partial mirror-coating 32, which renders the lamp shown suitable to be used as a traffic light lamp.

We claim:

1. An electric lamp comprising a translucent lamp vessel, an electric element in the lamp vessel, current supply conductors extending to the electric element, a lamp cap connected to the lamp vessel and having a sheath portion and a base portion carrying an electric contact member, the electric contact member having a surface through which a current supply conductor is passed to the exterior, the said current supply conductor being welded on said surface, characterized in that the current supply conductor is held at the surface by a separately supplied solidified welding drop essentially of copper, nickel, copper/nickel, chromium/nickel/iron or aluminium containing 0 to 10% by weight of a metal addition.

2. An electric lamp as claimed in claim 1, characterized in that the metal addition is chosen from silver, tin, aluminium, iron, niobium or manganese.

* * * * *